United States Patent [19]

Stäbler

[11] Patent Number: 4,976,071

[45] Date of Patent: Dec. 11, 1990

[54] CLAMPING FIXTURE FOR AXIALLY CLAMPING A TOOL IN PLACE, IN PARTICULAR A DISC

[75] Inventor: Manfred Stäbler, Leinfelden-Echterdingen, Fed. Rep. of Germany

[73] Assignee: Robert Bosch GmbH, Stuttgart, Fed. Rep. of Germany

[21] Appl. No.: 378,187

[22] PCT Filed: Nov. 28, 1987

[86] PCT No.: PCT/DE87/00555

§ 371 Date: May 26, 1989

§ 102(e) Date: May 26, 1989

[87] PCT Pub. No.: WO88/04596

PCT Pub. Date: Jun. 30, 1988

[30] Foreign Application Priority Data

Dec. 17, 1986 [DE] Fed. Rep. of Germany ..... 3643067

[51] Int. Cl.[5] ..... B24B 41/04

[52] U.S. Cl. ..... 51/168

[58] Field of Search ..... 51/168, 217 R, 217 T, 51/217 L; 269/236, 126, 127, 128, 129, 192, 193, 195, 233

[56] References Cited

U.S. PATENT DOCUMENTS

| | | | |
|---|---|---|---|
| 526,420 | 9/1894 | Thomas | 269/236 |
| 946,152 | 1/1910 | Peglar | 269/236 |
| 1,226,029 | 5/1917 | Tessmer | 269/236 |
| 1,539,057 | 5/1925 | Ridderstrom | 51/168 |
| 2,157,345 | 5/1939 | Nelson | 269/236 |
| 2,454,309 | 11/1948 | Davis | 269/236 |
| 2,518,112 | 8/1950 | Anthony | 269/126 |
| 2,815,052 | 12/1957 | Krasnow | 269/236 |
| 2,908,303 | 10/1959 | Schmidt | 269/236 |
| 3,528,203 | 9/1970 | Franklin et al. | 51/168 |
| 4,237,659 | 12/1980 | Welsch et al. | 51/168 |
| 4,622,123 | 11/1986 | Nejame, Jr. | 269/233 X |
| 4,706,963 | 11/1987 | Geuss | 269/236 X |

*Primary Examiner*—Frederick R. Schmidt
*Assistant Examiner*—Bruce P. Watson
*Attorney, Agent, or Firm*—Michael J. Striker

[57] ABSTRACT

A clamping device for portable grinding machines comprising a clamping nut which can be screwed on to the end-side threaded step (13) of the drive spindle (10) to clamp a grinding disk (15) in place. The clamping nut carries a clamping fork (22) which, with its fork leg ends (26, 27), is held so as to be movable about a diametral pivot axis (30) between a clamping position and a loosened position. The ends (26, 27) are provided with eccentric pressing surfaces (28, 29) which decrease with regard to the eccentricity during the pivoting from the clamping position to the release position and act axially on the grinding disk (15) via a pressing disk (36). For releasing, the clamping fork (22) is pivoted about the pivot axis, surface areas of decreasing eccentricity of the pressing surfaces (28, 29) becoming effective. In the process, the thread (14, 20) is relieved and the clamping nut loosened, which can be fully unscrewed manually by taking hold of the clamping fork (22). This enables a grinding disk to be changed quickly and safely without a tool (FIG. 1).

8 Claims, 6 Drawing Sheets

FIG. 2
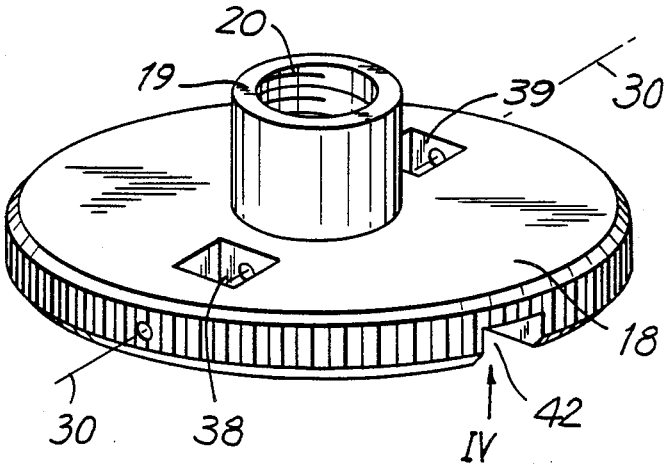
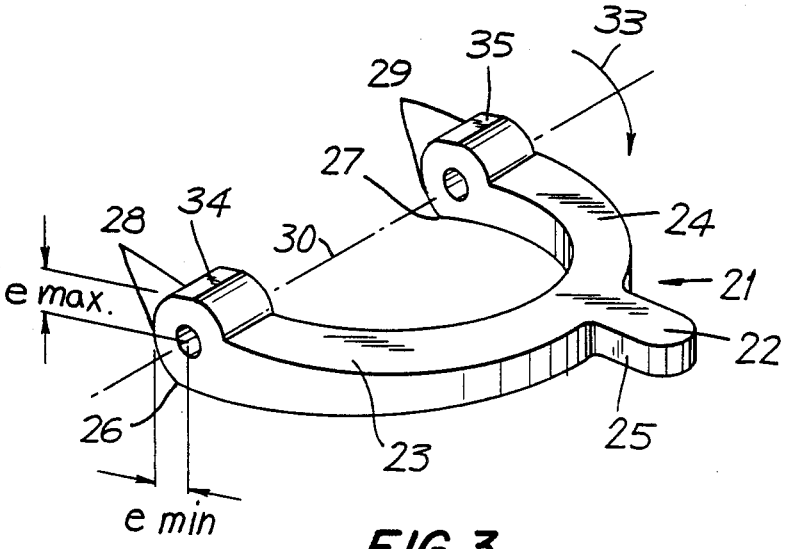
FIG. 3

FIG. 5
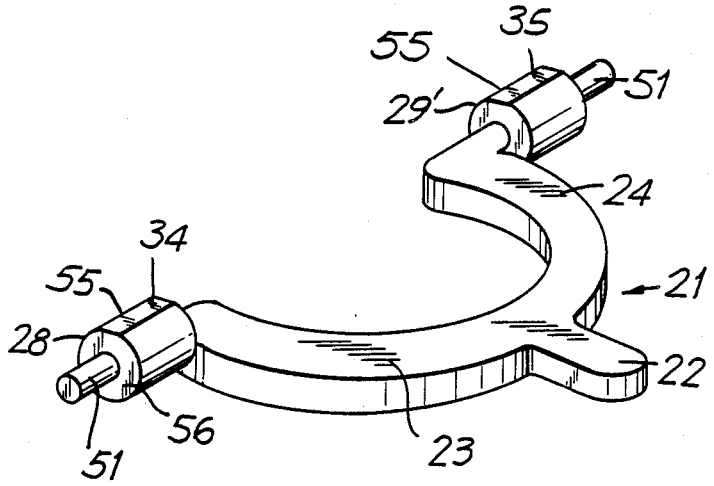
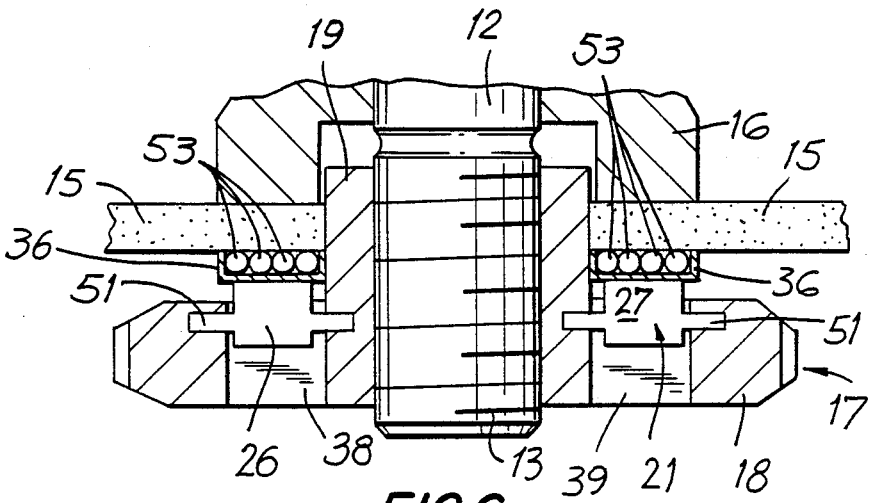
FIG. 6

CLAMPING FIXTURE FOR AXIALLY CLAMPING A TOOL IN PLACE, IN PARTICULAR A DISC

BACKGROUND OF THE INVENTION

My invention relates to a clamping device or chuck for axially clamping a tool and, more particularly, to a clamping device for a tool used in a portable powered hand tool, e.g. for a grinding disk in a portable grinding machine.

My invention is based on a chuck for axially clamping a tool, especially a disk-shaped tool or tool disk, on a flange of a driven spindle comprising a clamping nut which is provided with an internal thread and which can be screwed onto an end-side threaded step of the spindle, and a clamping member which is positioned axially between the tool on one side and the clamping nut on the other side and can press the tool against the flange. A clamping fixture of the said type has been disclosed (German Patent Specification No. 3,012,836) in which the clamping member consists of an element which is roughly hat-shaped in cross-section and is axially supported against the flange of the clamping nut via a helical spring. When the clamping nut is screwed on and tightened, the hat-shaped clamping element is pressed axially against the tool via the axially compressed spring, and the tool is thereby tightened against the flange on the spindle side, the end face of a cylindrical extension of the clamping nut coming to bear directly on a facing axial side of the flange on the spindle side and, during further tightening of the clamping nut, the flange on the spindle side being tightened together with the clamping nut. This is to ensure in an angle grinder that the grinding disc is mounted with a definite contact pressure and that this contact pressure remains at the right level. This clamping device is also intended to permit a quick and simple replacement of the grinding disk and at the same time avoid overloading of the powered hand tool, in particular the angle grinder. This is because, if the torque acting on the grinding disk is too great, the grinding disc stops, while the flange and also the clamping nut having the clamping member perform a relative movement thereto. The effect of the clamping nut automatically tightening further in operation, which otherwise makes it considerably more difficult to loosen the clamping nut when changing the grinding disk, is counteracted with this clamping fixture. Nonetheless, loosening of the clamping nut is here only possible with the assistance of a special auxiliary tool. The spindle, depending on the design of the machine, must be appropriately counterheld by a second auxiliary tool, e.g. a spanner.

SUMMARY OF THE INVENTION

Accordingly, it is an object of the present invention to provide a clamping device for axially clamping a tool, especially a grinding disk, in which a tool change can be made without an aixiliary tool such as a spanner. Another object is to be able to easily modify existing power tools.

In keeping with these objects and with others which will become apparent hereinafter, the clamping member is held on the clamping nut so as to be movable relative to the clamping nut between a clamping position and a loosened position and has at least one pressing surface dropping axially in a direction of motion from the clamping position to the loosened position.

In the clamping device according to the invention having the characterizing features of the main claim, the following advantages result. A tool change is made possible without any auxiliary tool. This tool change, in addition, can be performed quickly and safely. A further advantage is that powered hand tools already existing can also be changed over without special redesign. For example, a simple exchange of the clamping nut is sufficient for this purpose. Since, when the clamping member is transferred from the clamping position into the release position, the axial clamping force of the clamping fixture is reduced and removed to such an extent that axial force no longer acts on the thread, the spindle, in the release position, when the clamping nut is unscrewed further by hand, is no longer loaded by a torque. Only the thread friction of the relieved thread has to be overcome. Therefore a special spindle-locking device, as is otherwise present in certain powered hand tools, is not required on the machine side. Where there is no spindle-locking device, it is not necessary, when unscrewing the clamping nut, for the spindle to be counterheld with an additional auxiliary tool, e.g. a spanner. In spite of that, the clamping nut can as before be designed conventionally, e.g. as standard, so that it is still possible in especially stubborn cases, e.g. in the event of a rusted-in clamping nut, for a spanner to be placed thereon and for the clamping nut to be released with this auxiliary tool.

Advantageous further developments and improvements of the clamping fixture specified in the main claim are possible by the features recited in the subclaims.

There are several advantageous embodiments of my invention. The clamping member can be held on the clamping nut so as to be pivotable about a diametral pivot axis and has at least one pressing surface which is eccentric with regard to this pivot axis and whose radial distance from the pivot axis decreases in the pivoting direction. An intermediate member, e.g. a pressure disk, to transmit pressure more uniformly can be arranged between the pressing surfaces and the tool. The clamping tool may be in the form of a clamping fork with two fork legs having fork leg ends which partially rest in recesses in the clamping nut and which is pivotably mounted in the clamping nut. Each fork leg end can have an eccentric pressing surface which acts directly or indirectly via the pressing disk on the tool.

BRIEF DESCRIPTION OF THE DRAWINGS

An exemplary embodiment of the invention is described in greater detail below and is shown in the drawing, in which:

FIG. 2 is a schematic perspective view merely of the clamping nut of the clamping device, FIG. 3 is a schematic perspective view merely of the clamping member.

FIG. 5 is a schematic perspective view of another embodiment of a clamping member according to our invention.

FIG. 6 is a schematic, axial longitudinal section through another embodiment of a clamping device according to our invention.

DETAILED DESCRIPTION OF THE INVENTION

Figure 1:
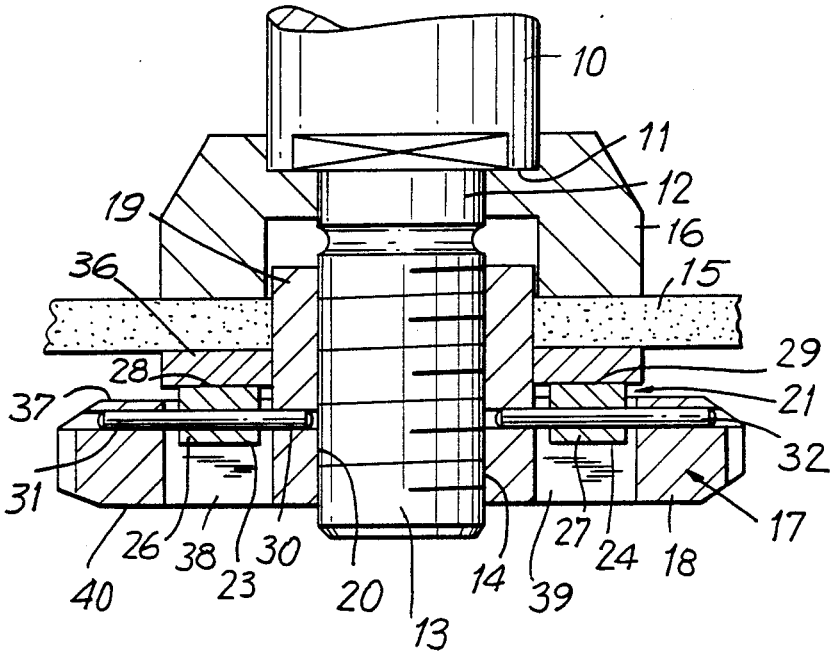
FIG. 1 is a schematic, axial longitudinal cross sectional view of a clamping device as part of an angle grinder having a mounted grinding disk.

FIG. 1 schematically shows the lower part of a portable powered hand tool which is designed, for example, as an angle grinder and has a spindle 10 which is motor-driven via a gearing and, at the end, merges via an annular shoulder 11 into a cylindrical step 12 of smaller diameter and then into an end-side threaded step 13 having an external thread 14. The spindle 10 serves to drive a tool 15 which consists, for example, of the grinding disk indicated or another tool disc, a rubber plate or the like. The tool 15 is mounted and clamped in place between a flange 16 and a clamping nut 17. The flange 16 is axially supported on the annular shoulder 11 and centered radially on the cylindrical step 12. It is coupled in a positive-locking manner to the spindle 10.

The clamping nut 17 has a flange 18 and a cylindrical sleeve part 19 protruding therefrom and is provided with a through-going internal thread 20 with which the clamping nut 17 is screwed onto the external thread 14 of the threaded step 13. The tool 15 is centered on the outer peripheral surface of the cylindrical sleeve part 19 during mounting.

Arranged in the axial area between the tool 15 on the one side and the clamping nut 17 on the other side is a clamping member 21 which here consists of a clamping fork 22. In the exemplary embodiment shown (FIG. 3), the clamping fork 22 has two fork legs 23, 24, each of which is curved and which together form a roughly semicircular curved part from which a manipulating nose 25 protrudes. Of the two fork legs 23, 24, only their ends 26 and 27 respectively can be seen in FIG. 1. This clamping member 21 can be acted upon by the clamping nut 17 by an axially directed pressing force and is able to press axially against the tool 15 and press the latter against the axial end face of the flange 16.

Figure 8:
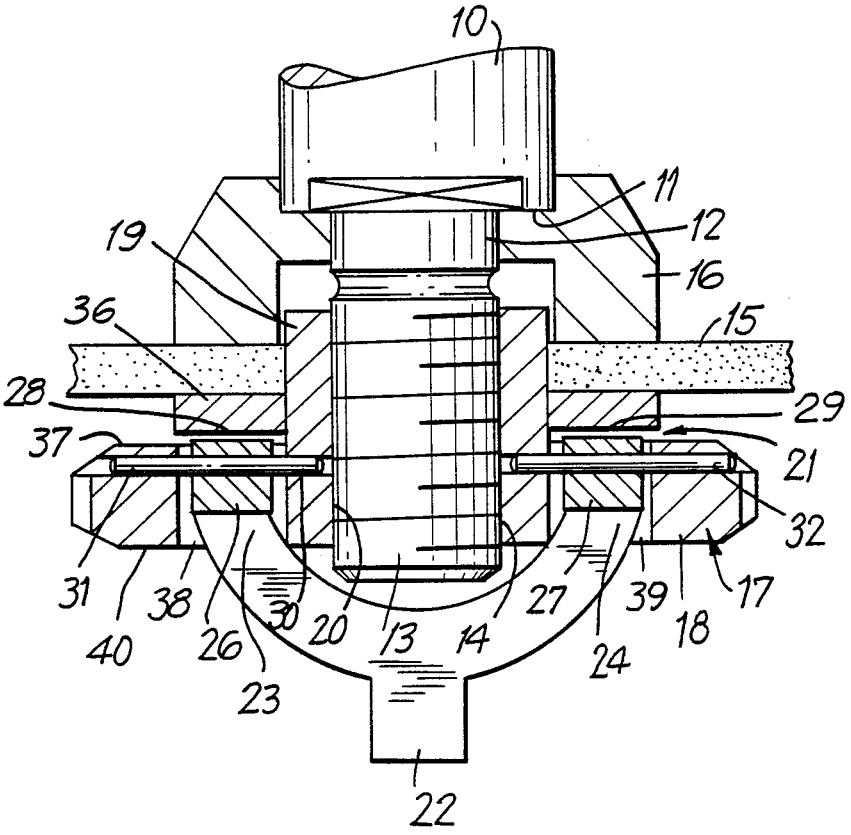
FIG. 8 is a schematic axial cross sectional view through the embodiment shown in FIG. 1 with the clamping member in a loosened state.

The clamping member 21 in the form of the special clamping fork 22 is held so as to be movable relative to the clamping nut 17 between a clamping position shown in FIG. 1 and a release position or in a loosened state shown in FIG. 8. For each end 26, 27 of the fork leg 23, 24, it has an axially directed pressing surface 28 and 29 which drops in a direction of movement from the clamping position (FIG. 1) to the release position (FIG. 8).

In the exemplary embodiment shown, the clamping member 21 in the form of the clamping fork 22 is held so as to be pivotably movable on the clamping nut 17 about a preferably diametral pivot axis 30 by means of bearing pins 31 and 32 respectively. The respective pressing surface 28 or 29 is eccentric with regard to the pivot axis 30. If the clamping fork 22 is located in its clamping position according to FIG. 1, which roughly corresponds to the horizontal pivot position according to FIG. 3, the part of the pressing surface 28 or 29 having the greatest eccentricity e max, with regard to the pivot axis 30, is effective. If, on the other hand, the clamping fork 22, with regard to FIG. 1, is pivoted downwards and in arrow direction 33 about the pivot axis 30 into the release position, the part of greatest eccentricity of the pressing surface 28, 29 is moved away and the part of the pressing surface 28, 29 which has an eccentricity decreasing with increasing pivot angle down to the minimum eccentricity e min comes into function.

The respective pressing surface 28, 29, roughly in the surface area of greatest eccentricity e max, has a surface portion 34 and 35 (FIG. 3), or instead a surface portion having an eccentricity already reduced again. This ensures that, when clamping fork 22 is located in the clamping position according to FIGS. 1 and 3, it is in a stable clamping position around the pivot axis 30.

In principle, the clamping nut 17 with the pressing surface 28, 29 of the clamping fork 22 can axially act directly upon the tool 15. A better pressure distribution in the peripheral direction is achieved when an intermediate member in the form of a pressure disk 36 is also arranged between the tool 15 and the pressing surface 28, 29, this pressure disk 36 is in turn acted upon by the eccentric pressing surface 28, 29 and presses axially with an end face against the tool 15. The pressure disk 36 is likewise centered on the cylindrical sleeve part 19 of the clamping nut 17 and guided in an axially movable manner.

Figure 4:
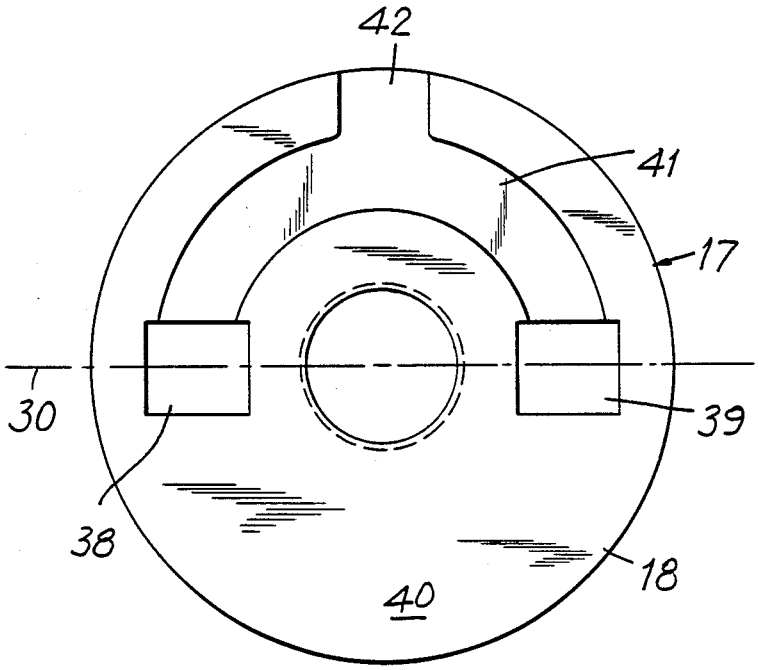
FIG. 4 is a schematic bottom view of the clamping nut in arrow direction IV in FIG. 2.
Figure 7:
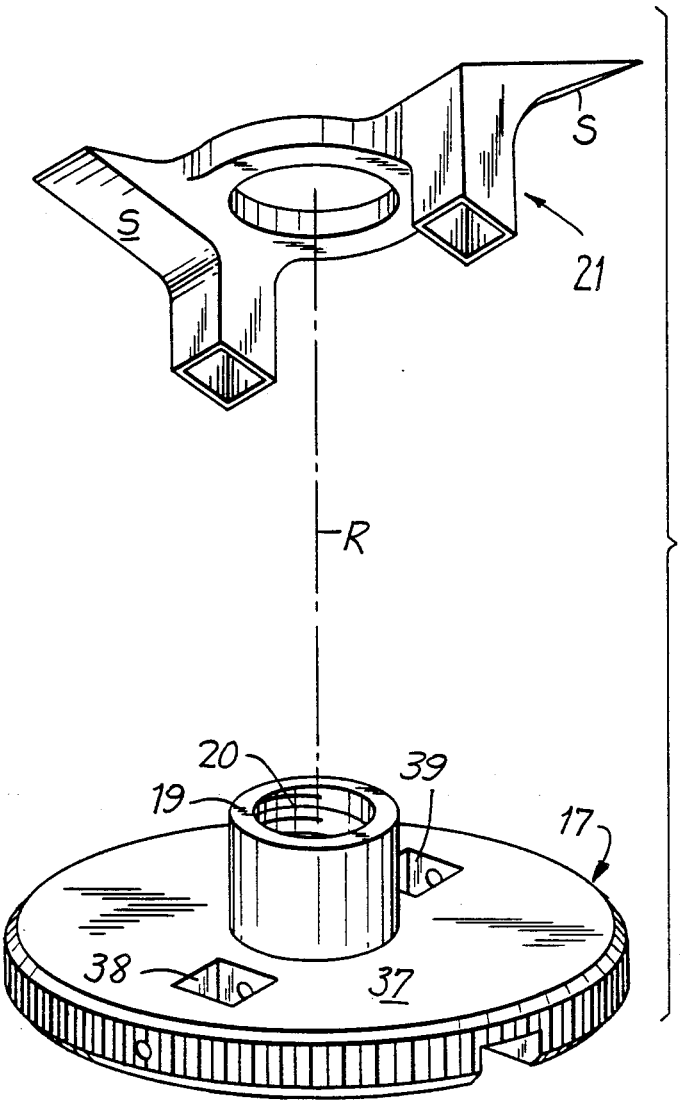
FIG. 7 is a schematic perspective view of an additional embodiment of a clamping member according to out invention.

As is apparent from FIG. 1, each end 26, 27 of the fork legs 23 and 24 respectively, with the eccentric pressing surface 28 and 29 respectively, protrudes in the axial direction beyond the end face 37, pointing towards the tool 15, of the flange 18 of the clamping nut 17 so that the clamping nut 17, solely with this pressing surface 28, 29, exerts axial pressing force on the tool 15 via the pressure disk 36. Contained in the flange 18 are apertures 38 and 39 which are located diametrically opposite one another along the pivot axis 30 and in which at least the ends 26 and 27 of the fork legs 23 and 24 respectively are accommodated. Provided the ends 26, 27 of each fork leg 23 and 24 respectively are offset by an appropriate distance from the latter, the clamping fork 22, in the clamping position according to FIGS. 1, 3, can rest on the end face 40, pointing downwards in FIG. 1, of the clamping nut 17 and can protrude downwards beyond this end face 40 provided this does not cause further obstruction. Another advantageous design follows from FIGS. 2 and 4. Contained here in the end face 40 of the clamping nut 17 are recesses 41, 42 which are dimensioned to be so wide and deep that, when clamping fork 22 is located in clamping position, its two curved fork legs 23, 24 find space in the recess 41 and its manipulating nose 25 finds space in the recess 42 so that the clamping fork 22 does not protrude axially beyond the lower end face 40 of the clamping nut 17.

FIG. 1 shows the clamping device in the clamping position in which the tool 15, via the clamping nut 17 plus clamping fork 22 and via the pressure disk 36, is clamped axially in place on the flange 16.

If the tool 15 is to be removed and changed, first of all, by taking hold of the manipulating nose 25, the clamping fork 22 is pivoted downwards in arrow direction 33 about the pivot axis 30 in FIGS. 1 and 3. In the process, the pressing surface 28, 29 slides along on the allocated end face of the pressure disc 36, the surface area of greatest eccentricity e max being pivoted away and a surface area which has an eccentricity decreasing as a function of the pivot angle down to e min moving into this region. The result of this is that the internal thread 20 and external thread 14 are relieved and thus the axial clamping force acting on the tool 15 from the clamping nut 17 is reduced to such an extent that hereafter the clamping nut 17 can be completely unscrewed from the threaded step 13 by hand. In the process, the clamping member 21 now pivoted into release position can facilitate the unscrewing movement by being grasped for unscrewing.

If the tool 15 has been exchanged and a new one is to be mounted and clamped, the procedure is as follows. First the flange 16 is slipped onto the spindle 10. After this, the new tool 15, together with the pressure disk 36, is located in position and then the clamping nut 17 is placed on and screwed onto the threaded step 13. In the process, its cylindrical sleeve part 19 passes through the tool 15 and the pressure disk 36, which is centered thereon. When the clamping nut 17 is being screwed on, the clamping fork 22 is swung into its clamping position according to FIGS. 1, 3 in which it is held firmly on account of the flat portions 34, 35. During work with the hand tool, i.e. when the motor is switched on and the spindle 10 is driven rotationally, the clamping nut 17, as usual, tightens further automatically.

The clamping device described is exceptionally simple, cost-effective and quick, safe and easy to handle. It enables the tool 15 to be quickly and safely changed without requiring additional special tools for this purpose. A further advantage is that existing powered hand tools, in particular grinding machines, can also be subsequently equipped with this clamping device without further redesign. For this purpose, only the clamping nut, in general, needs to be replaced by the clamping nut 17 according to the invention having pressure disk 36. Furthermore, it is advantageous that, when the clamping fork 22 is being transferred from the clamping position according to FIG. 1 into the release position, no torque is exerted on the spindle 10 so that powered hand tools equipped with such a clamping device no longer require an integrated spindle-locking device. This is because, to unscrew the clamping nut 17, after the transfer into the release position, only the thread friction of the relieved thread 14, 20 has to be overcome and therefore a very small moment has to be applied. For this purpose, the friction on the machine side from the spindle 10 up to the drive motor is sufficient as a brace for the spindle 10.

In addition, the clamping nut 17 is designed in such a way that, as before, it also enables, if necessary, a special tool to be applied, e.g. in the form of a pin-type face spanner, so that in particularly stubborn cases, e.g. in the slightly rusted state, the clamping nut 17 can also be loosened in a conventional manner by means of an auxiliary tool.

The clamping fixture described is suitable for clamping all possible tools 15 and in connection with various types of powered hand tool. It is especially suitable for grinding machines, e.g. angle grinders, and here for clamping disk-shaped tools 15 in place.

In another exemplary embodiment shown in FIG. 5, instead of the sliding friction, rolling friction is present between the clamping member 21, exerting the axial clamping force, and the tool 15 or the pressure disk 36. Thus the pressing surface 28, 29 is, for example, in each case provided on a rolling element 5 of the clamping member. The rolling element 5 can, for example, consist of an eccentric roller 56.

In this embodiment there are two rolling elements 55 mounted on axles 51 which engage in clamping nut 17.

In another exemplary embodiment as shown in FIG. 6, the clamping member 21 is configured as clamping fork 22 according to the first exemplary embodiment. In this arrangement, an intermediate member permitting rolling friction is located between the pressing surface 28, 29 on the one side and the pressure disk 36 or the tool 15 directly on the other side, which intermediate member, for example, has a plurality of rollers 53, e.g. needle bodies, which, during the movement of the clamping member 21, are acted upon by the pressing surface 28, 29 and permit rolling friction instead of the sliding friction. In this way, the stability is increased and, furthermore, the clamping fork 22 can be pivoted from the clamping position into the release position in an especially easy-running manner.

In another exemplary embodiment (not shown), the clamping member is held so as to be rotationally movable relative to the clamping nut 17 about a rotational axis R coaxial to the clamping nut 17. In this arrangement, it has a sloping surface S which, with regard to a flat axial surface of the clamping nut 17, rises in one direction and whose axial distance from the flat axial surface decreases in the rotational direction from the clamping position to the loosened position.

It will be understood that each of the elements described above, or two or more together, may also find a useful application in other types of structures differing from the types described above.

While the invention has been illustrated and described as a clamping device or chuck for axially clamping a tool, especially a tool disk, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A clamping device for axially clamping a tool, in particular, a disk tool on a flange of a rotatable spindle having an end-side threaded step, said clamping device comprising a clamping nut having an inner thread cooperating with the end-side threaded step of the spindle for securing the tool on the spindle; and a clamping member axially positioned between the tool and said nut, said clamping member being supported on said clamping nut for pivotal movement relative thereto about a substantially diametral axis and having pressure surface means for applying a clamping force to the tool, said pressure surface means comprising at least one pressure surface arranged eccentrically relative to said substantially diametral axis, an axially moveable pressure disk positioned between the tool and said clamping member, said clamping member comprising a clamping fork having two fork legs with fork leg ends, said two fork leg ends are pivotally mounted on said clamping nut about the diametral axis, each of said fork leg ends having an eccentric pressing surface which protrudes axially beyond a clamping nut end face and acts via said pressure disk upon the tool, wherein said clamping nut is provided with a plurality of recesses, and said clamping fork with said fork legs is at least partially accommodated in said recesses in the clamping position.

2. A clamping device according to claim 1, wherein said clamping member is pivotably movable between clamping and release positions, a radial distance of said one pressure surface from said substantially diametral axis decreasing in a direction of a pivotal movement of said clamping member from the clamping position to the release position.

3. A clamping device according to claim 1, wherein said said clamping member includes a rolling element defining said pressure surface means.

4. A clamping device according to claim 3, wherein said rolling element comprises an eccentric roller.

5. A clamping device according to claim 1, wherein said pressure disk comprises a plurality of rollers which during movement of said clamping member, roll on said at least one pressing surface.

6. A clamping device according to claim 1, wherein said eccentric pressing surface has a flat area located substantially in an area of maximum eccentricity.

7. A clamping device according to claim 1, wherein said clamping fork with said fork legs partially rests in the clamping position on said clamping nut end face adjacent the tool and partially protrudes beyond a portion of said end face.

8. A clamping device for axially clamping a tool, in particular, a disk tool on a flange of a rotatable spindle having an end-side threaded step, said clamping device comprising a clamping nut having an inner thread cooperating the end-side threaded step of the spindle for securing the tool on the spindle; and a clamping member axially positioned between the tool and said nut, said clamping member being supported on said clamping nut for pivotal movement relative thereto about a substantially diametral axis and having pressure surface means for applying a clamping force to the tool, said pressure surface means comprising at least one pressure surface arranged eccentrically relative to said substantially diametral axis, an axially moveable pressure disk positioned between the tool and said clamping member, said clamping member comprising a clamping fork having two fork legs with fork leg ends, said fork leg ends are pivotally mounted on said clamping nut about the diametral axis, each of said fork leg ends having an eccentric pressing surface which protrudes axially beyond a clamping nut end face and acts via said pressure disk upon the tool, wherein said clamping nut has a flange provided with apertures and said fork leg ends are accommodated in said apertures.

* * * * *